US005439285A

United States Patent [19]

Lautenschläger

[11] Patent Number: 5,439,285

[45] Date of Patent: Aug. 8, 1995

[54] SYSTEM FOR FASTENING DRAWER BOTTOMS

[75] Inventor: Horst Lautenschläger, Reinheim, Germany

[73] Assignee: MEPLA-Werke Lautenschläger GmbH & Co. KG, Reinheim, Germany

[21] Appl. No.: 243,956

[22] Filed: May 17, 1994

[30] Foreign Application Priority Data

Jun. 2, 1993 [DE] Germany ..... 9308254 U
Jun. 15, 1993 [DE] Germany ..... 43 19 716.7

[51] Int. Cl.[6] ..... A47B 88/00

[52] U.S. Cl. ..... 312/348.1; 312/330.1; 312/348.2; 312/348.4; 403/298

[58] Field of Search ..... 312/330.1, 348.1, 348.2, 312/348.4; 403/298, 359, 374, 282, 283

[56] References Cited

U.S. PATENT DOCUMENTS

| | | | |
|---|---|---|---|
| 3,527,486 | 9/1970 | Gamp | 403/298 X |
| 3,926,491 | 12/1975 | Greer | 312/348.2 |
| 4,720,625 | 1/1988 | Arney et al. | 403/298 X |
| 4,815,796 | 3/1989 | Röck | 312/263 X |
| 4,842,351 | 6/1989 | Röck et al. | 312/330.1 X |
| 4,875,747 | 10/1989 | Hollenstein | 312/330.1 X |
| 5,017,182 | 5/1991 | Mabie | 403/298 X |
| 5,088,851 | 2/1992 | Hutter | 403/298 X |
| 5,090,786 | 2/1992 | Albeiz et al. | 312/330.1 X |
| 5,147,123 | 9/1992 | Berger | 312/348.1 |
| 5,163,774 | 11/1992 | Lautenschlager | 312/330.1 X |

FOREIGN PATENT DOCUMENTS

| | | | |
|---|---|---|---|
| 289866 | 11/1988 | European Pat. Off. | 312/348.4 |
| 3911353 | 10/1990 | Germany | 312/348.1 |
| 9216508 | 4/1993 | Germany . | |
| 2000436 | 1/1979 | United Kingdom | 312/348.4 |
| 1632414 | 3/1991 | U.S.S.R. . | |
| 1639613 | 4/1991 | U.S.S.R. . | |

*Primary Examiner*—Jose V. Chen
*Assistant Examiner*—Rodney B. White

[57] ABSTRACT

A system for fastening the bottom (14) of a drawer to the drawer's sides, in which projecting strips (26, 24) projecting integrally from the sides and running in the direction in which the drawer is opened overlap the top and/or bottom sides of the drawer bottom, and/or a projecting strip (28*a* ) enters into a longitudinal groove (30) made in the edge (32) of the drawer bottom facing the drawer sides. At least one anchoring projection is provided in the area of the drawer sides (12) facing the adjacent edge (32) of the bottom which when the drawer is assembled, penetrates into the material of the bottom (14), and which either overlaps the projecting strips (24, 26, 28*a* ) at right angles to the drawer-opening direction or is offset from them.

12 Claims, 3 Drawing Sheets

SYSTEM FOR FASTENING DRAWER BOTTOMS

BACKGROUND OF THE INVENTION

1. Field of the Invention

The invention relates to a system for fastening the bottom of a drawer to the sides of the drawer, in which projecting strips integral with the drawer sides and running in the direction in which the drawer opens overlap the top side and/or bottom side of the drawer bottom and/or a projecting strip fits into a longitudinal groove made in the edge of the drawer bottom confronting the drawer side.

2. The Prior Art

In the manufacture of drawers extruded pieces of metal or plastic are increasingly used in addition to the classical wood materials. Metal drawer sides can be made, for example, by the extrusion process from aluminum or can be stamped and edged from sheet metal. Plastic drawer sides are, as a rule, extruded and cut to the desired length or also made by the injection molding method from plastic. In such drawer side extrusions, the drawer bottom, which is still made of wood, as a rule, is placed on a projecting strip integral with the drawer side, or is inserted between two projecting strips spaced one over the other to adapt to the thickness of the bottom. For the additional attachment of the bottom to the sides, a so-called "harpoon strip" is often provided, i.e., a fastening strip provided on both faces with parallel anchoring ribs of sawtooth-like cross section, which is forced into a longitudinal groove made in the edge of the drawer bottom facing the drawer side and having a width that is less than the rib thickness measured across the apexes of the sawtooth-shaped ribs. These sawtooth-like anchoring ribs embed themselves, after the drawer-side strips with the bottom are pressed into the side walls of the longitudinal groove, and then offer a high resistance to the withdrawal of the harpoon strip from the longitudinal groove against the direction in which they were forced in. Now, it has been found that in some cases, under certain unfavorable conditions, the fastening of the bottom to the drawer sides can become critical, and it has been observed that, in the case of heavily loaded drawers which are frequently opened and closed with great force, on account of the shocks which develop when the drawer front strikes against the cabinet carcase, the drawer bottom can drift in the drawer-closing direction, even when the drawer side has been joined to the drawer bottom by the said harpoon strips. Such drifting can be prevented by additional measures, e.g., driving screws through holes in one of the projecting strips into the drawer bottom, but this involves additional installation effort, which is undesirable in modern large-series production.

The invention is addressed to the problem of providing a fastening system for joining the bottom of a drawer to the sides thereof, which without requiring additional, complicated measures will reliably prevent any drifting of the drawer bottom relative to the drawer sides even when the drawer is heavily loaded and subjected to shock-like stresses.

This problem is solved according to the invention in that, in the area of the drawer sides facing the adjacent lateral edge of the bottom, at least one anchoring projection is provided which penetrates into the material of the bottom when the drawer is assembled, and which extends over the projecting strips or is offset therefrom. Such an anchoring projection penetrating into the material of the bottom thus constitutes a positive securing of the drawer bottom against displacement in the drawer closing direction.

If the drawer side is fastened by means of a projecting harpoon strip in a groove made on the edge of the drawer bottom, a configuration may be desirable in which the harpoon strip has on its length at least one interruption, in which case a rib-like projection running transversely across the harpoon sections in the area of the interruption projects from the drawer side as an anchoring projection.

The transverse rib-like projection is then best sharpened like a knife-edge on its free edge pointing away from the drawer side, in order to facilitate penetration into the material of the bottom in the assembly procedure, and prevent damage to the drawer bottom.

Alternatively, in at least one interruption of the harpoon strip, a piece flush with the harpoon strip sections can project from the drawer side as an anchoring means which has anchoring teeth projecting beyond the dimension of the greatest thickness of the harpoon strip and penetrating into the material of the groove in the drawer sides when assembled.

These tooth-like anchoring projections can then best have sharpened knife-edges at right angles to the drawer-opening direction and to the flat surfaces of the drawer side which facilitate penetration of the anchoring projections into the groove in the drawer sides.

In further modification of the invention, at least one anchoring projection can protrude from the free edge—then best continuous and uninterrupted—confronting the drawer bottom of the harpoon strip, which upon installation penetrates into the bottom of the groove created in the edge of the drawer bottom and receiving the harpoon strip. Such an anchoring projection then can best be in the form of a pin of circular or polygonal cross section which is sharpened at its free end.

It is advantageous if the anchoring projection or projections are an integral part of the associated drawer side.

BRIEF DESCRIPTION OF THE DRAWINGS

The invention is further explained in the following description of several embodiments, in conjunction with the drawing, wherein.

DETAILED DESCRIPTION OF THE PREFERRED EMBODIMENT

Figure 1:
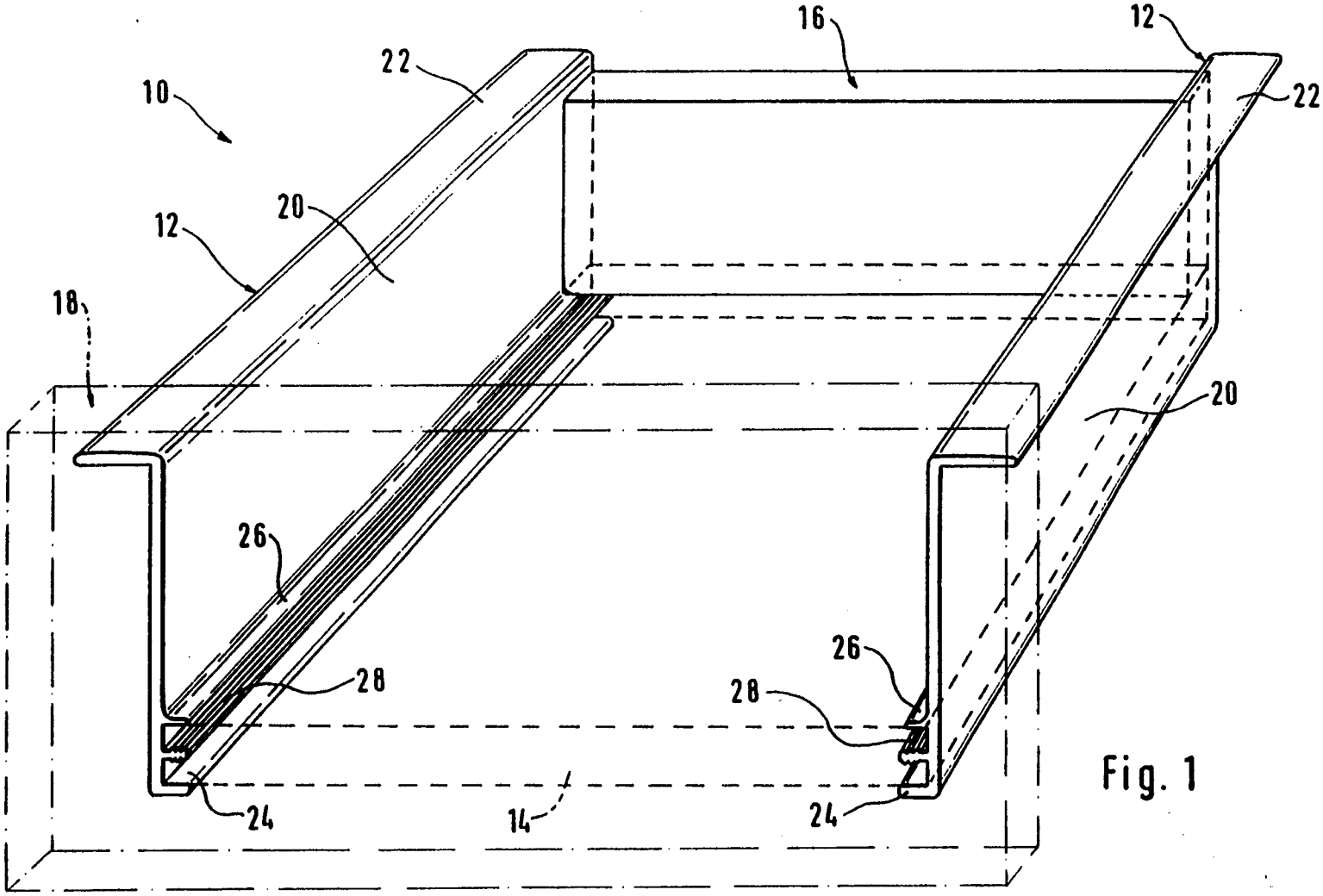
FIG. 1 is a perspective view of a drawer whose sides are conventional plastic extrusions, the drawer front and the bottom of the drawer being indicated only in broken and dash-dotted lines.

FIG. 1 shows schematically a drawer identified as a whole by 10, which in this form is known, and which is composed of two drawer-side cross-sectional shapes made in this case from an aluminum alloy by extrusion, a wood bottom 14 indicated in broken lines in the drawing, a wood back wall 16 and a drawer front 18 indicated in dash-dotted lines. The way in which the back 16 and the drawer front 18 are joined to the sides 12 of the drawer is not represented since it is not subject matter of the invention. Conventional, known hardware can be used for this purpose.

Figure 2:
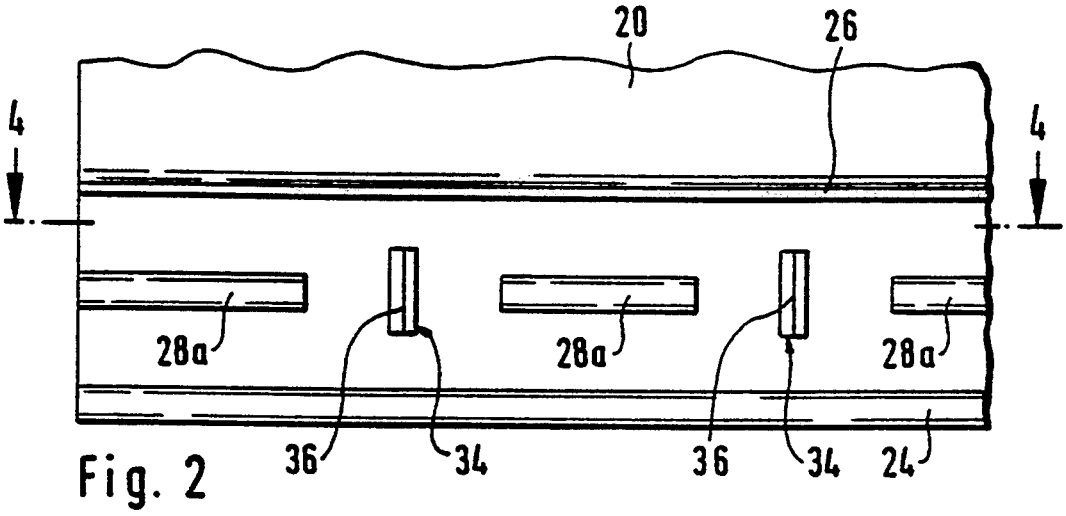
FIG. 2 is a top view of a portion of a drawer side extrusion in the area of its bottom margin for attachment to the drawer bottom, configured according to the invention.
Figure 3:
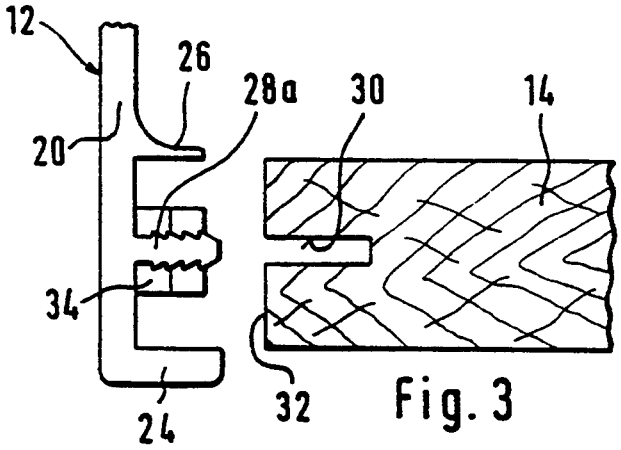
FIG. 3 is a side view of the drawer-side section shown in FIG. 2, additionally showing the marginal area of a bottom be joined to the drawer side.

The drawer sides 12, which in this form are known, have a vertical web 20 laterally defining the interior of the drawer, whose upper margin is integral with a narrower flange 22 turned outwardly at right angles. At the bottom margin a total of three projecting strips and offset vertically from one another project at right angles toward the drawer bottom 14. The bottom projecting strip 24 reaches beneath the drawer bottom 14 and the upper strip 26 overlaps it, i.e., the distance between the projecting strips 24 and 26 corresponds approximately to the thickness of the bottom 14. The upper side of the upper projecting strip, which is visible in the assembled drawer 10, is rounded in cross section in a cove-like manner, thereby facilitating the cleaning of the drawer in the area of the transition between the bottom 14 and the drawer sides 12. The projecting strip running approximately in the center between the projecting strips 24 and 26 is configured as a continuous harpoon strip 28 which can be driven or pressed into an undersized groove 30 (FIGS. 3 and 6) in the confronting edge 32 of the bottom 14. In the embodiment represented in FIGS. 2 to 4, the drawer side extrusion differs from the known one represented in FIG. 4 in that the harpoon strip is interrupted at regular intervals, so that it is formed of a number of shorter-length harpoons 28a spaced apart in the opening direction of the drawer.

Within the interruptions, rib-like projections 34 reach crosswise from the web 20 of the drawer-side and are sharpened on their free edge 36.

It can be seen that these transverse rib-like projections, which reach above and below the harpoons 28a, will cut into the edges of the bottom 14 when the drawer sides 12 and bottom 14 are pressed together, and thus bring about a secure fixation of the bottom against displacements relative to the drawer sides 12 in the direction in which the drawer is opened and closed.

Figure 5:
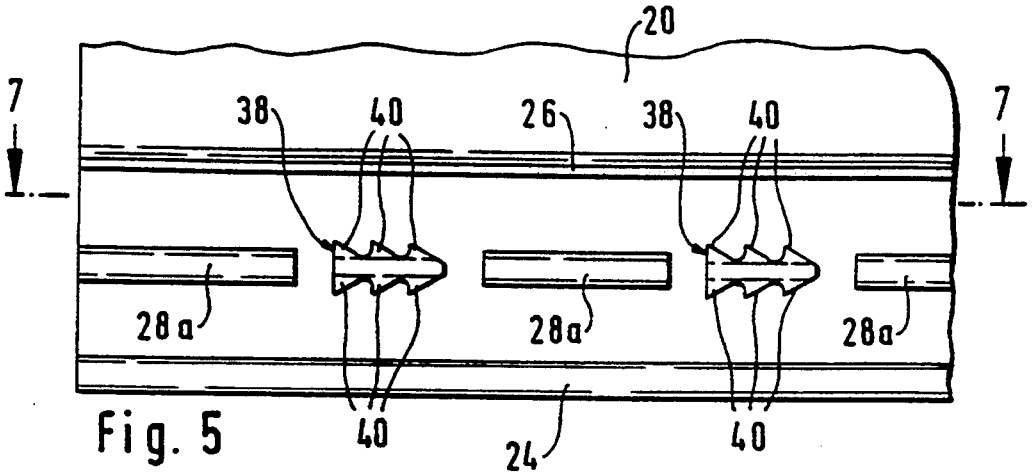
FIG. 5 is a view corresponding to FIG. 2 of a drawer-side section with a different configuration of the anchoring projections.
Figure 6:
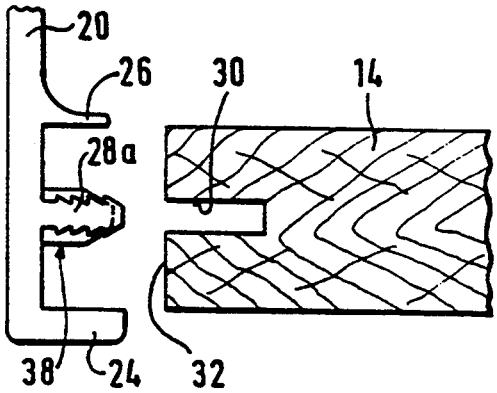
FIG. 6 is a view corresponding to FIG. 3 of the drawer-side section and the marginal area of the corresponding drawer bottom.
Figure 7:
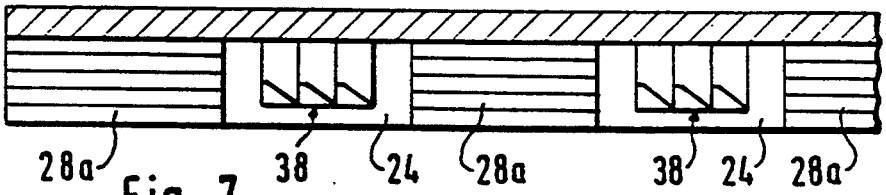
FIG. 7 is a sectional view, as seen in the direction of the arrows 7—7 in FIG. 5.

The drawer-side member 12 represented in FIGS. 5 to 7 differs from the one explained above, which is shown in FIGS.1 to 3, only with regard to the shape of the anchoring projections. Instead of the transverse rib-like projections 34, here projections 38 are provided which are in line with the harpoons 28*a*, and they have laterally extending anchoring projections 40 of sawtooth cross section whose thickness is greater than the maximum thickness of the harpoons 28a. These anchoring projections are thus provided with knife-edges penetrating into the groove 30 in the drawer bottom 14, and thus again, hold the bottom 14 securely against displacement in the drawer-closing direction relative to the drawer sides 12. By arranging the anchoring projections described in positions alternately rotated 180°, the bottom can also be secured in place in the drawer-opening direction.

Figure 4:
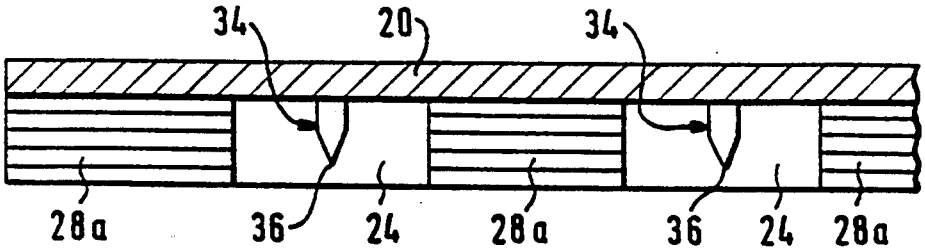
FIG. 4 is a sectional view of the drawer-side section, as seen in the direction of the arrows 4—4 in FIG. 2.
Figure 8:
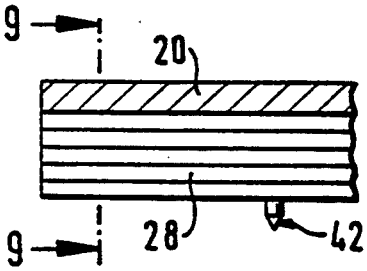
FIG. 8 is a sectional view corresponding to that of FIGS. 4 and 7 of an additionally modified section of a drawer-side extrusion, in which the anchoring projections are provided on the free edge of the continuous harpoon strip.
Figure 9:
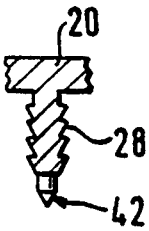
FIG. 9 is a sectional view seen in the direction of arrows 9—9 in FIG. 8.

In the embodiment according to FIGS. 8 and 9, however, a continuous harpoon strip 28 is provided which is basically the same as the harpoon strip 28 of the drawer-side members 12 shown in FIG. 4. To fix the bottom 14 in the drawer-closing direction, additional anchoring projections are provided, in the form of short, pointed pins 42 on the free end of the harpoon strip 28, which will penetrate into the bottom of the groove when the harpoon strip 28 is forced into the groove 30. In this manner the desired securing of the proper installed position of the bottom 14 relative to the drawer-side member 12 in the drawer-closing direction is assured.

It is clear that modifications and further development of the embodiments described can be achieved in the scope of the invention. Thus, anchoring projections projecting into the face of the drawer bottom can also be provided laterally beside a harpoon strip. In drawer wall profiles in which a harpoon strip is not provided, i.e., the bottom 14 is placed only between projections 24 and 26, the anchoring projections can protrude directly from the web 20 in the interstice between the projections 24 and 26. It is important only that the joining of the drawer bottom 14 with the drawer side members 12 be secured by anchoring projections extending from the web 20 substantially at right angles to the drawer-opening direction and penetrating into the edge 32 of the bottom 14.

It is apparent that modifications and further developments of the especially described embodiments can be made within the scope of the idea of the invention. Thus, the securing of the drawer side against displacement relative to the bottom can be accomplished in a similar manner also in the case of extruded or injection molded plastic drawer sides. The anchoring projection or projections do not have to be in line with or created on the harpoons, but can project from the inside surface of the drawer side facing the adjacent edge of the bottom at a different level than the harpoons, and can thus penetrate into the bottom alongside the groove that receives the harpoons. Also, the especially described shape of the anchoring projections can be modified. It is essential only that, after penetrating into the edge of the drawer bottom they produce, in addition to the harpoons in the groove in the drawer bottom, a positive anchoring of the drawer side to the bottom. At the same time it can easily be possible for the anchoring projections to be made separately at first and then fastened in the anchoring area on the drawer side. Lastly, it is also to be noted that the securing according to the invention can also be applied to drawer sides in which the bottom is held only by clamping between the top and bottom projecting strips 26 and 24, i.e., no harpoon strip at all is provided. In other words, only the anchoring projection or projections which then penetrate into the then ungrooved adjacent edge of the drawer bottom will project from the portion of the drawer side situated between the projecting strips. This also applies to drawer sides in which the bottom projecting strip 24 supporting the drawer bottom is eliminated, so that the drawer bottom is then held only between the harpoon strip and the upper projecting strip.

I claim:

1. A system for fastening the bottom of a drawer to sides of a drawer, comprising: drawer sides having an area which faces an adjacent lateral edge of the drawer bottom; projecting strips; integral with the drawer sides and running in a direction in which the drawer opens, which overlap a top side and a bottom side of the drawer bottom; and a further projecting strip, configured as a harpoon strip, which enters into a groove made in the edge of the drawer bottom, wherein said harpoon strip has at least one interruption over its length which divides the harpoon strip into sections and, in an area of the interruption, a rib-like projection running transversely to the harpoon strip sections projects as an anchoring projection which penetrates into the drawer bottom when the drawer is assembled, and which reaches beyond the projecting strips at right angles to the direction in which the drawer opens.

2. A fastening system according to claim 1, wherein the transversely running rib-like projection (34) is sharpened like a knife-edge on its free edge (36) pointing away from the drawer side.

3. A fastening system according to claim 2, wherein each of said at least one anchoring projection is an integral part of the associated drawer side (12).

4. A fastening system according to claim 1, wherein each of said at least one anchoring projection is an integral part of the associated drawer side (12).

5. A fastening system according to claim 1, wherein an elongated projection configured as a harpoon flange enters into the groove (30) made in the edge (32) of the drawer bottom (14), further comprising the harpoon flange has over its length at least one interruption, which divides harpoon flange into sections, and that in an area of the interruption a section (38) aligned with the harpoon flange sections **(28*a*) projects as an anchoring projection from the drawer side (12)**, and has tooth-like anchoring projections protruding beyond a dimension of the harpoon flange whereby its thickness is greatest, which penetrate into side walls of the groove.

6. A fastening system according to claim 5, wherein each of said at least one anchoring projection is an integral part of the associated drawer side (12).

7. A fastening system according to claim 5 wherein the tooth-like anchoring projections (40) have sharpened knife-edges running at right angles to direction in which the drawer opens and to the drawer sides in their portion that penetrates into the side walls of the groove.

8. A fastening system according to claim 4, wherein each of said at least one anchoring projection is an integral part of the associated drawer side (12).

9. A fastening system according to claim 5, wherein at least one anchoring projection protrudes from the free edge of the harpoon flange (28) confronting the drawer bottom (14) that is to be installed, and during assembly penetrates into a bottom of the groove (30) made in the edge (32) of the drawer bottom and receiving the harpoon flange (28).

10. A fastening system according to claim 9, wherein each of said at least one anchoring projection is an integral part of the associated drawer side (12).

11. A fastening system according to claim 9, wherein the anchoring projection is in a pin like form (42) sharpened at its free end.

12. A fastening system according to claim 11, wherein each of said at least one anchoring projection is an integral part of the associated drawer side (12).

* * * * *